US007927196B2

(12) United States Patent
Bugler, III et al.

(10) Patent No.: US 7,927,196 B2
(45) Date of Patent: Apr. 19, 2011

(54) LOUVER MODULE

(75) Inventors: Thomas William Bugler, III, Frederick, MD (US); Scott A. Nevins, Gettysburg, PA (US)

(73) Assignee: EVAPCO, Inc., Taneytown, MD (US)

( * ) Notice: Subject to any disclaimer, the term of this patent is extended or adjusted under 35 U.S.C. 154(b) by 232 days.

(21) Appl. No.: 11/776,759

(22) Filed: Jul. 12, 2007

(65) Prior Publication Data

US 2009/0017748 A1 Jan. 15, 2009

(51) Int. Cl.
*F24F 7/00* (2006.01)
*F28B 3/00* (2006.01)
*B01D 45/08* (2006.01)

(52) U.S. Cl. ..... 454/277; 165/113; 55/440; 454/309

(58) Field of Classification Search ..... 454/309, 454/277; 165/113; 55/440
See application file for complete search history.

(56) References Cited

U.S. PATENT DOCUMENTS 3,628,442 A 12/1971 Nijhuis
4,514,202 A 4/1985 Kinney, Jr. et al.
5,601,485 A 2/1997 Gigola
5,617,780 A 4/1997 Robbs
6,598,862 B2 7/2003 Merrill et al.
6,923,250 B2 8/2005 Hegg et al.
7,105,036 B2 9/2006 Shepherd

FOREIGN PATENT DOCUMENTS

JP 55118596 A * 9/1980

OTHER PUBLICATIONS

Computer English Abstract translation of JP 55118596 A.*
PCT/ISA/210, App. No. PCT/US2008/001757, Jun. 12, 2008, (2 pages).
PCT/ISA/220 Notification (2 pages).
PCT/ISA/237 Written Opinion (4 pages).
PCT/ISA/220 Notes (1 page).

* cited by examiner

*Primary Examiner* — Steve McAllister
*Assistant Examiner* — Helena Kosanovic
(74) *Attorney, Agent, or Firm* — Rader, Fishman & Grauer PLLC

(57) ABSTRACT

A louver module includes a louver module body that extends in a length-wise direction, a width-wise direction and a height-wise direction such that the length-wise direction, the width wise-direction and the height wise direction are oriented perpendicularly relative to one another. The louver module body has a plurality of air passageways extending through the louver module body generally in the width-wise direction. Each one of the plurality of air passageways has a serpentine configuration.

17 Claims, 20 Drawing Sheets

LOUVER MODULE

FIELD OF THE INVENTION

The present invention is related to a louver module. More particularly, the present invention is related to a louver module having a matrix of serpentine-shaped air passageways.

BACKGROUND OF THE INVENTION

Louver modules are commonly known in the art and are used for a variety of applications such as for cooling towers, closed circuit coolers and evaporative condensers. One example of a commercial application for louver modules is employed in a conventional heat exchanger 100 as described in U.S. Pat. No. 6,923,250 and as illustrated in FIGS. 1-6. The conventional heat exchanger 100 includes a cabinet 102 that houses an exhaust fan 104, a manifold 106, a direct heat exchanger medium 108 and a plurality of conventional louver modules 110. As is commonly known in the art, the manifold 106 supplies water via spray nozzles 112 in a spray form to the direct heat exchanger medium 108 while the exhaust fan draws air represented by the solid single-line arrows from outside the cabinet 102 though the louver modules 110. As the water flows downwardly along the direct heat exchanger medium 108 and as air is drawn upwardly by the exhaust fan 104 through the direct heat exchanger medium 108, heat is effectively exchanged between the flowing water and the moving air. After heat has been exchanged, the water drips into and accumulates in a water basin 113.

As shown in FIGS. 2-5, each louver module 110 forms a plurality of air passageways 116 having trapezoidal cross-sectional configurations defined between respective louver walls 118. As a shown in FIG. 4, each air passageway 116 is bent at an approximate central location X in a sideways V-shape as viewed in plan view as each air passageway 116 extends from outside and into the cabinet 102. Although a bent air passageway 116 introduces a slight pressure drop of the air pressure as air enters into the cabinet, there are advantages of having bent air passageways.

With reference to FIG. 4, sunlight represented by the dashed arrow SL cannot readily enter into the cabinet 102 as a result of bent air passageways. Significantly reducing the amount of sunlight that enters into the cabinet through the louver modules 110 retards the growth of algae, mold or microorganisms in the water basin 113. It is commonly known in the art of heat exchangers that growth of algae, mold or microorganisms is promoted by sunlight and prevention of such growth reduces maintenance cost of the heat exchanger. Furthermore, as shown in FIG. 5, the air passageways 116 are angled downwardly relative from the outside of the cabinet 102 to the inside of the cabinet 102 at an angle Z of approximately 100 in a width-wise direction extending parallel to a horizontal axis H. This downwardly orientation of the air passageways 116 into the cabinet 102 prevents or reduces an amount of water splashing out of the heat exchanger 100 and also allows any water that may have accumulated in the air passageway or on the backside of the louver module to drain back into the water basin.

However, there is a drawback in providing a louver module 110 having bent air passageways 116 as described above. Although bent air passageways 116 are effective in retarding the growth of algae, mold and microorganisms, the heat exchanger efficiency of such heat exchanger is reduced. As shown in FIG. 6, it has been observed in a laboratory setting that as air represented by the solid-line arrows enters into the cabinet 102 through the louver modules 110, the bent air passageways 116 cause the air above the water basin 113 and below the direct heat exchanger medium 108 to swirl (represented by solid-line arcuate arrows) in somewhat of a circular fashion. Such swirling of air inside the cabinet 102 above the water basin 113 and below the direct heat exchanger medium 108 causes poor air distribution within the cabinet and a reduction in air pressure in at least some areas below the direct heat exchanger medium 108 negatively impacting the flow of air over the water flowing downwardly on the direct heat exchanger medium 108 at these areas. It is desirable to maintain uniform air and water distribution across the heat exchanger medium to ensure optimal thermal efficiency.

Furthermore, a shown in FIGS. 4 and 6, the air enters into the cabinet 102 at an air entry angle Y relative to the horizontal axis H. It has been observed in the laboratory that the air entry angle Y at which the air enters the cabinet 102 contributes to this swirling effect.

It would be advantageous to provide a louver module having a plurality of air passageways that inhibit sunlight from entering into the water basin of a heat exchanger cabinet and simultaneously direct air to enter into the cabinet generally parallel to the width-wise direction of the louver module. It would be beneficial to provide a louver module having a plurality of air passageways that inhibits or eliminates air swirl inside the cabinet. The present invention provides this advantage and this benefit.

OBJECTS AND SUMMARY OF THE INVENTION

It is an object of the invention to provide a louver module with a plurality of air passageways that inhibit sunlight from entering into the cabinet of a heat exchanger and simultaneously permit air to enter into the cabinet generally parallel to the width-wise direction of the louver module.

It is another object of the invention to provide a louver module with a plurality of air passageways that inhibit sunlight from entering into the cabinet of a heat exchanger and simultaneously inhibit or eliminate air swirl inside the cabinet.

Accordingly, a louver module of the present invention includes a louver module body that extends in a length-wise direction, a width-wise direction and a height-wise direction such that the length-wise direction, the width wise-direction and the height wise direction are oriented perpendicularly relative to one another. The louver module body has a plurality of air passageways extending through the louver module body generally in the width-wise direction. Each one of the plurality of air passageways has a serpentine configuration.

These objects and other advantages of the present invention will be better appreciated in view of the detailed description of the exemplary embodiments of the present invention with reference to the accompanying drawings, in which:

BRIEF DESCRIPTION OF THE DRAWING FIGURES

DETAILED DESCRIPTION OF THE EXEMPLARY EMBODIMENTS

Hereinafter, embodiments of the present invention will be described with reference to the attached drawings. The structural components common to those of the prior art and the structural components common to respective embodiments of the present invention will be represented by the same symbols and repeated description thereof will be omitted.

Figure 1:
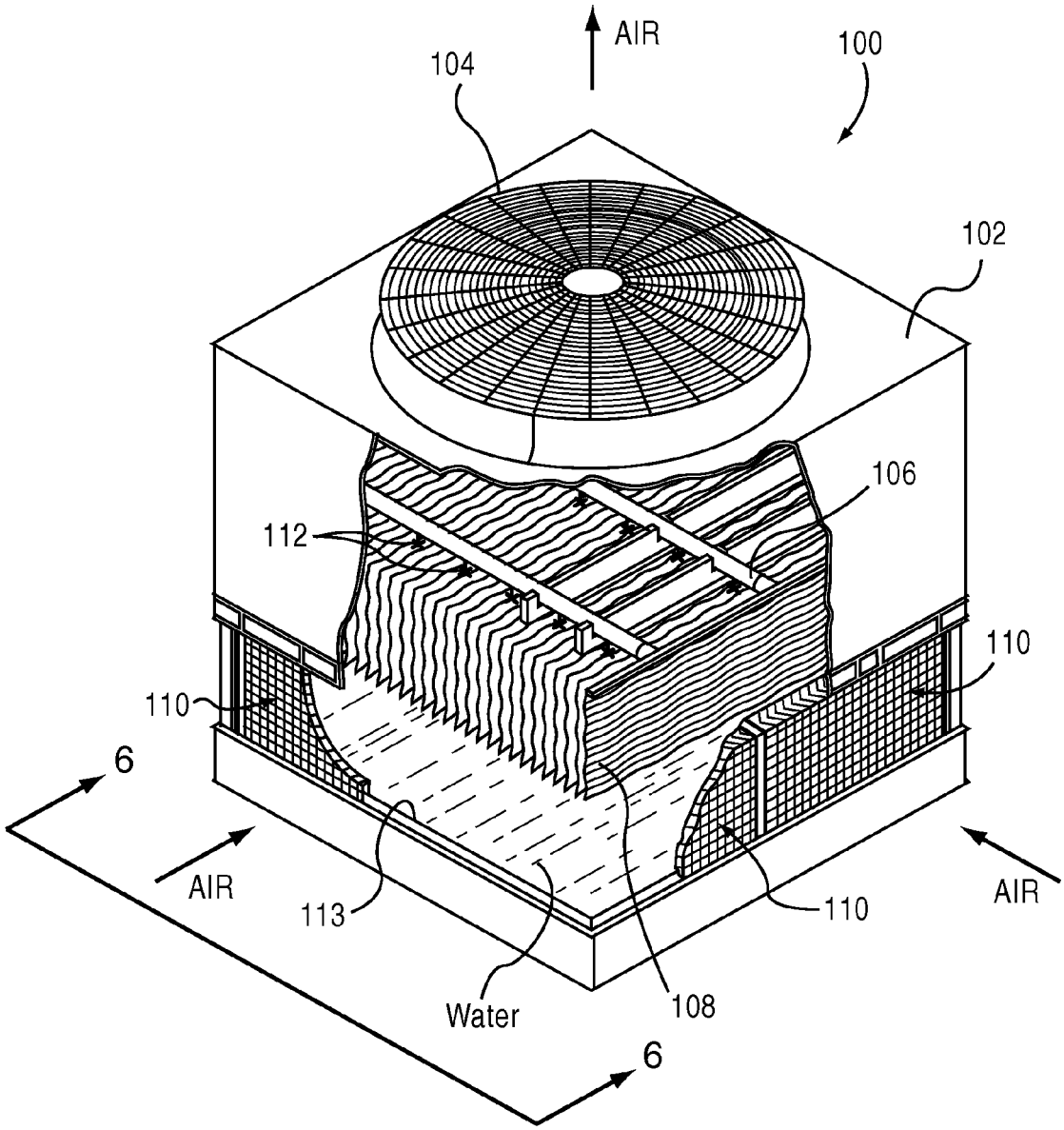
FIG.1 PRIOR ART
FIG. 1 is a perspective view shown partially broken away of a conventional heat exchanger.
Figure 2:
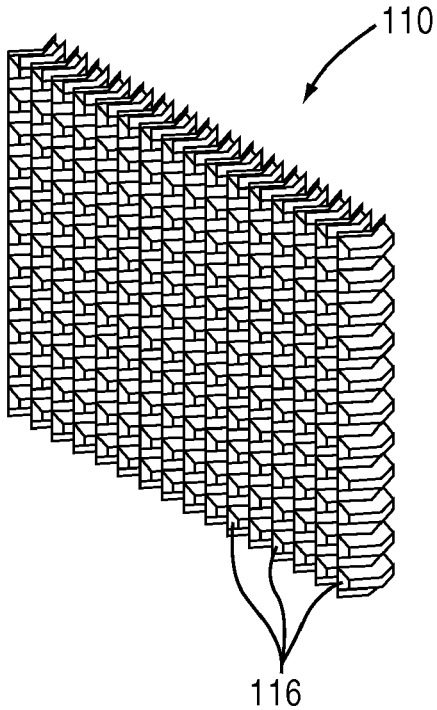
FIG.2 PRIOR ART
FIG. 2 is a perspective view of a conventional louver module employed with the conventional heat exchanger in FIG. 1.
Figure 3:
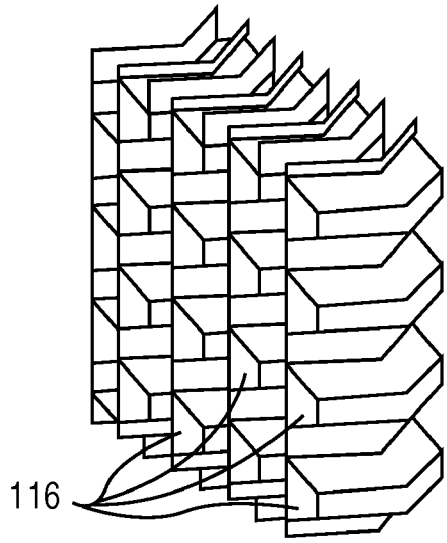
FIG.3 PRIOR ART
FIG. 3 is an enlarged partial perspective view of the conventional louver module shown in FIG. 2.
Figure 4:
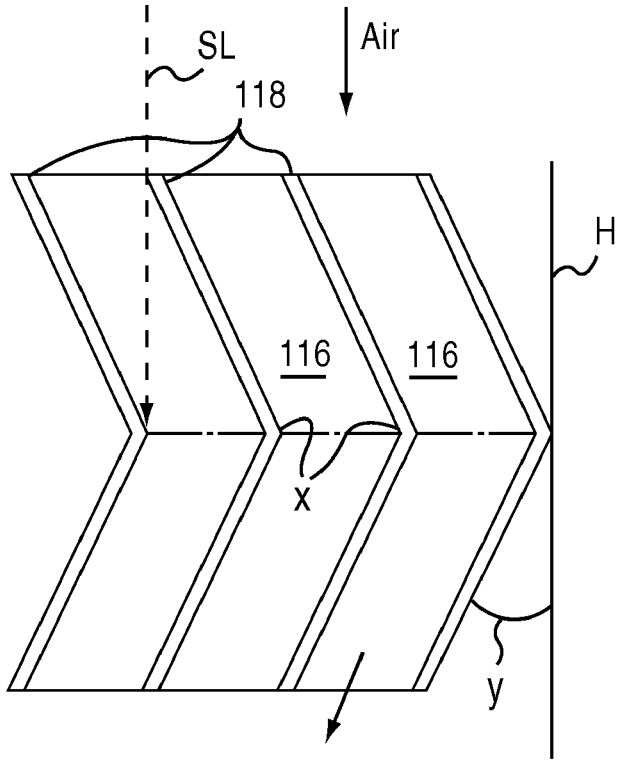
FIG.4 PRIOR ART
FIG. 4 is a top plan view of the conventional louver module shown in FIGS. 2 and 3.
Figure 5:
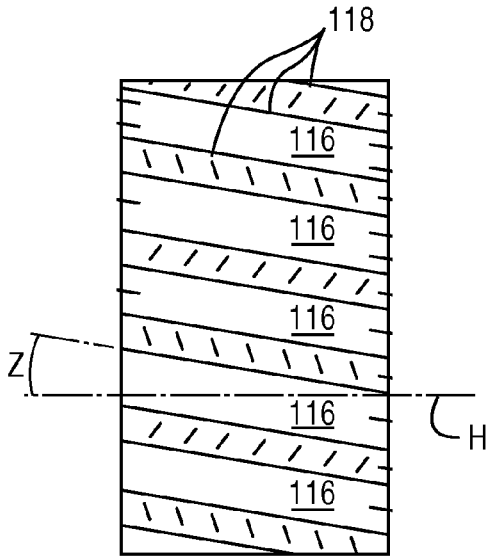
FIG.5 PRIOR ART
FIG. 5 is a side elevational view shown of the conventional louver module shown in FIGS. 2 and 3.
Figure 6:
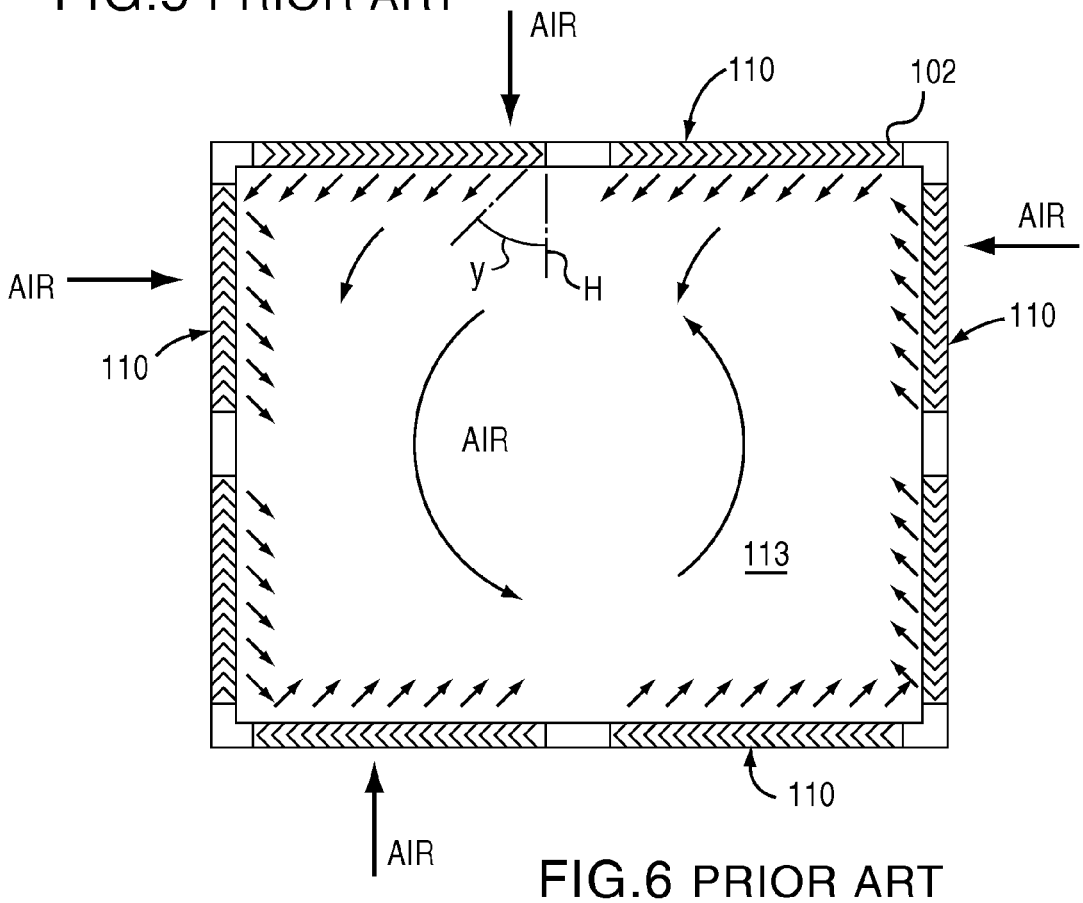
FIG.6 PRIOR ART
FIG. 6 is a top plan view taken along lines 6-6 in FIG. 1 illustrating air entering into a cabinet through conventional louver modules of the conventional heat exchanger resulting in air swirl.
Figure 7:
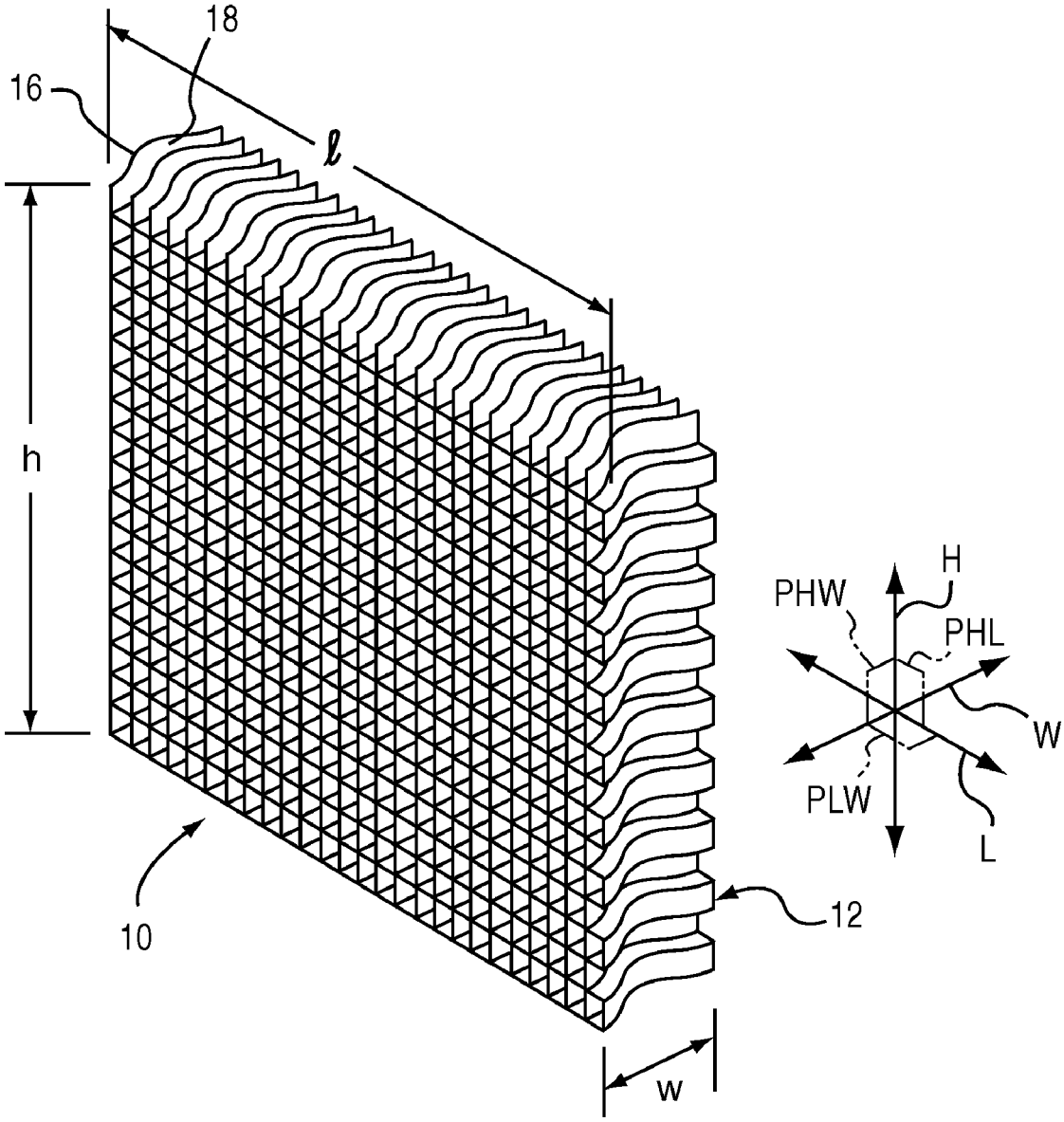
FIG. 7 is a perspective view of a first exemplary embodiment of a louver module of the present invention.
Figure 8:
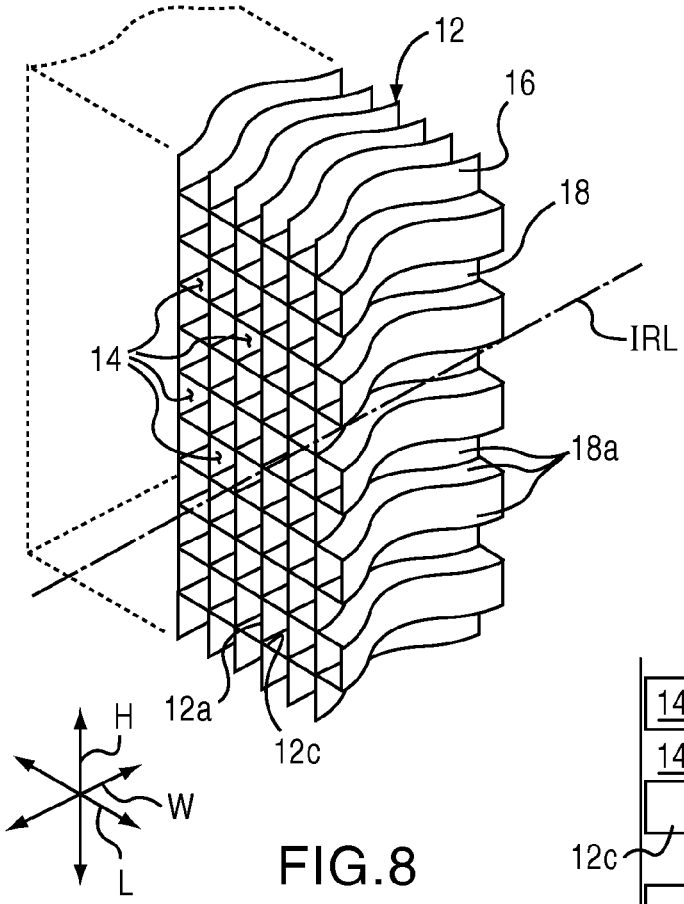
FIG. 8 is an enlarged partial perspective view of the louver module shown in FIG. 7.
Figure 9:
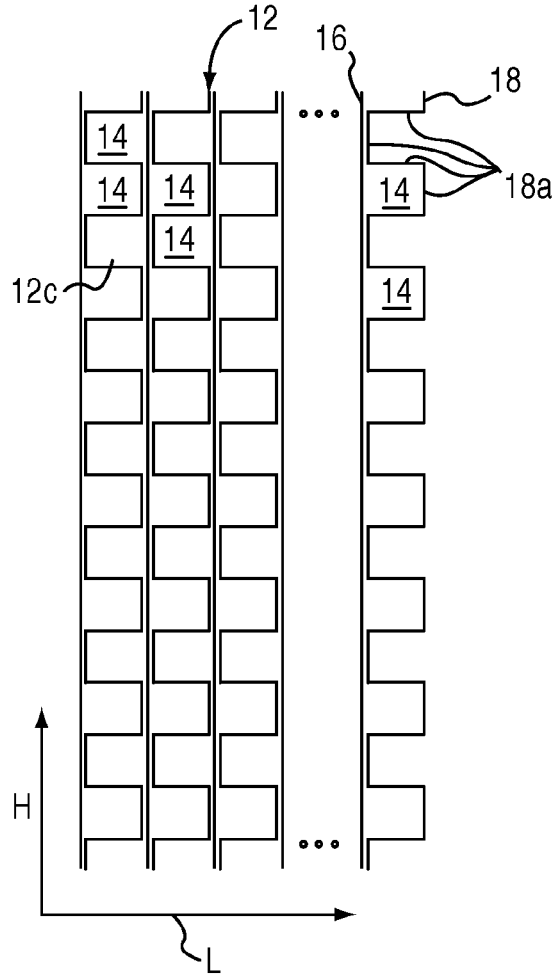
FIG. 9 is a side elevational view of the louver module shown in FIG. 7.
Figure 12:
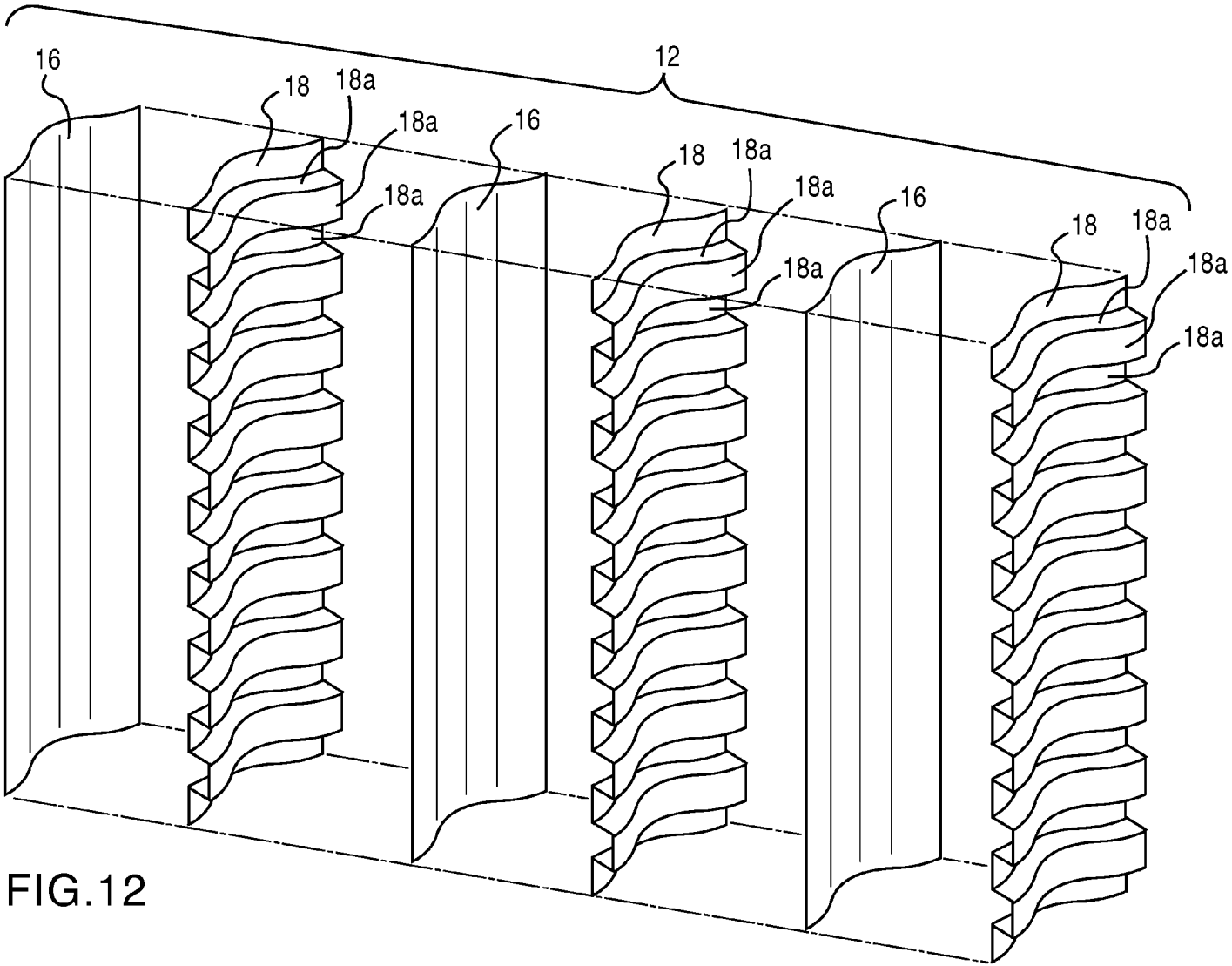
FIG. 12 is an exploded perspective view of the louver module shown in FIG. 7.
Figure 13:
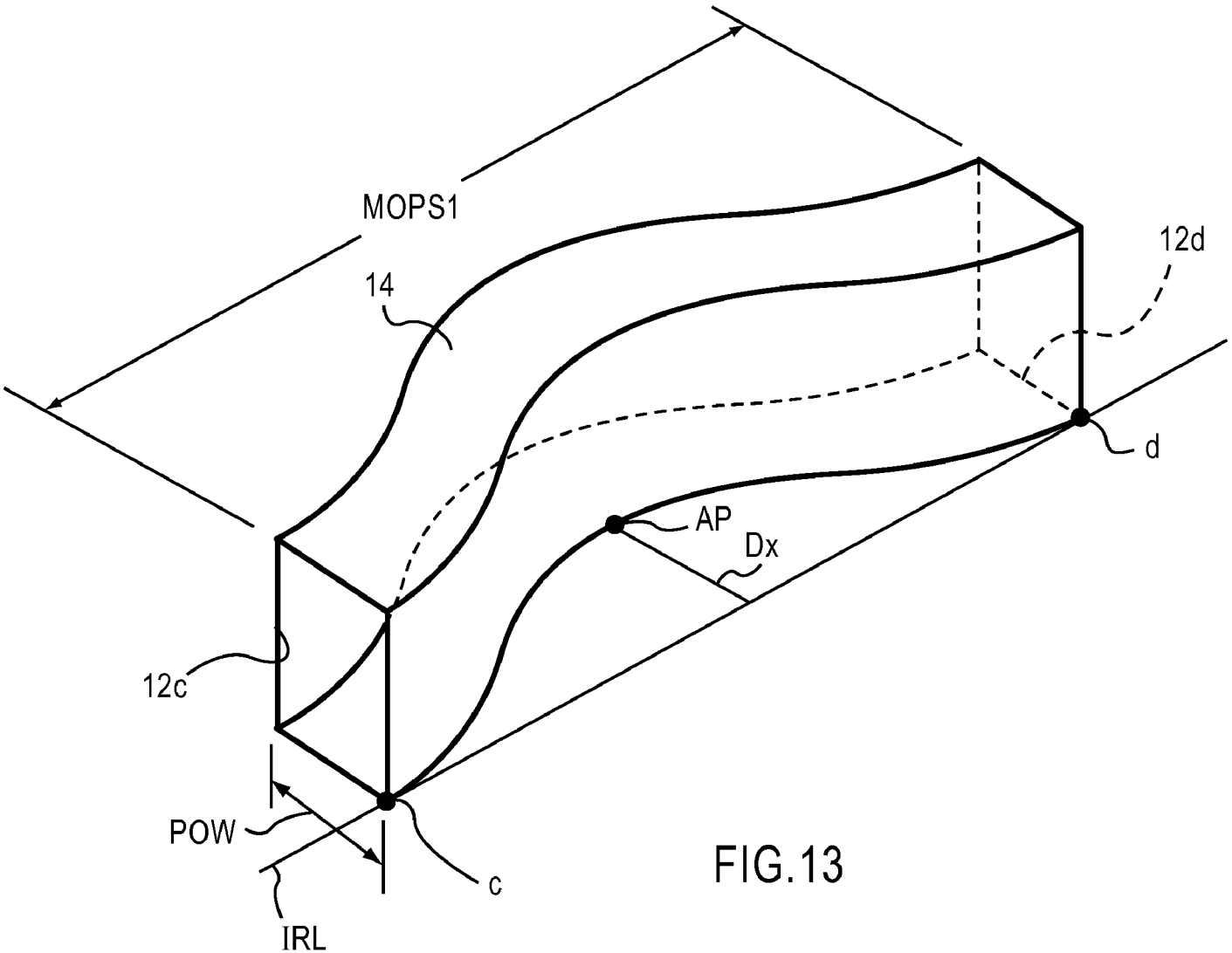
FIG. 13 is an enlarged perspective view of an air passageway of the louver module shown in FIG. 7.
Figure 14:
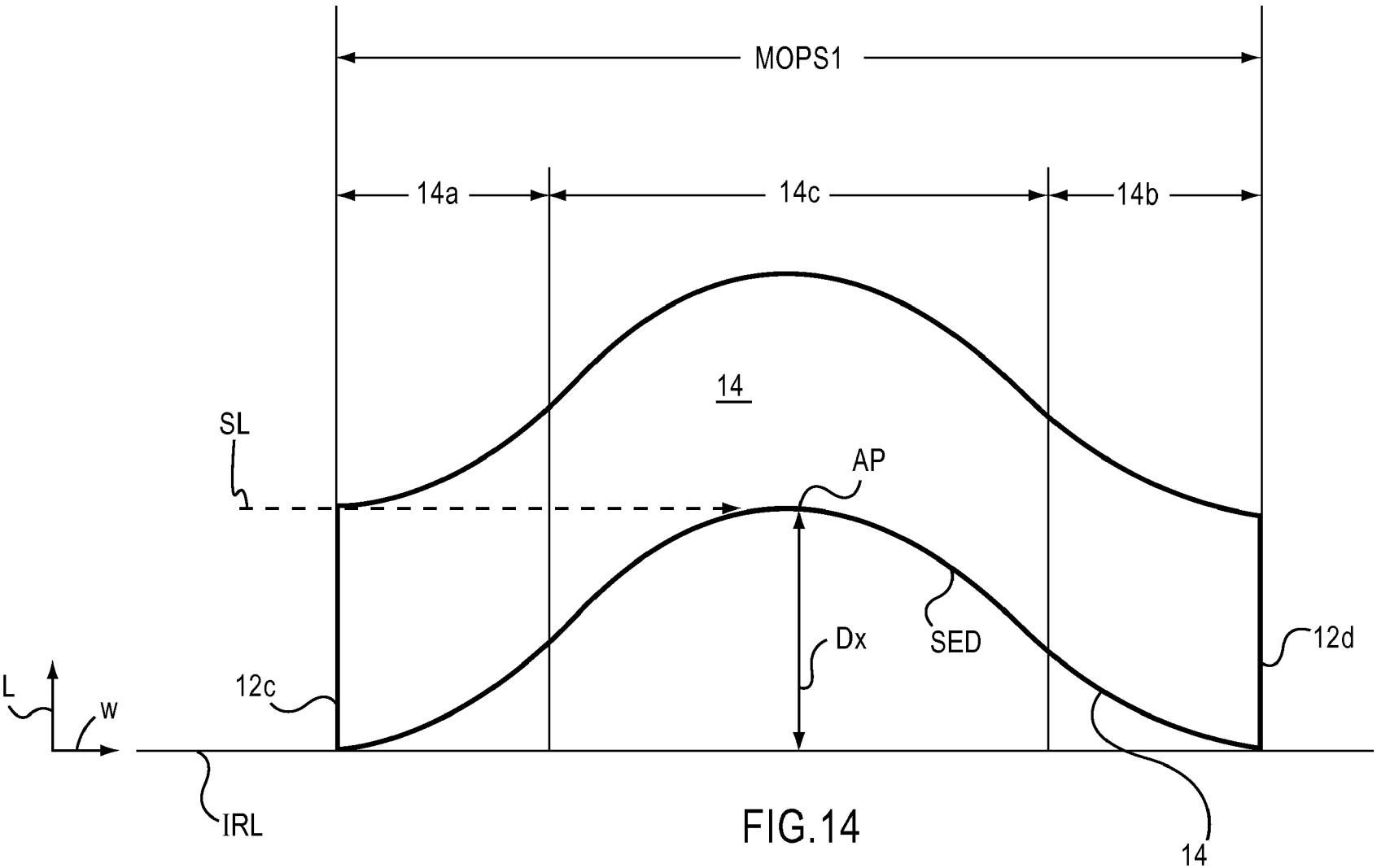
FIG. 14 is a top plan view of the air passageway shown in FIG. 13.

As generally introduced in FIGS. 7-14, a louver module 10 of a first embodiment of the present invention includes a louver module body 12 that extends in a length-wise direction L with a length 1, a width-wise direction W with a width w and a height-wise direction H with a height h. Specifically with reference to FIG. 7, the length-wise direction L, the width wise-direction W and the height-wise direction H are oriented perpendicularly relative to one another such that the length-wise direction L and the width-wise direction W define a length-width plane PLW, the height-wise direction H and the width-wise direction L define a height-width plane PHW and the height-wise direction H and the length-wise direction L define a height-length plane PHL. As best shown in FIGS. 8 and 9, the louver module body 12 has a plurality of air passageways 14 extending through the louver module body 12 generally in the width-wise direction W. As best shown in FIGS. 8 and 14, each one of the plurality of air passageways 14 has a serpentine configuration. Although not by way of limitation, for the first embodiment of the louver module 10 of the present invention, the serpentine configuration resembles a sinusoidal configuration in a form of a generally standard normal distribution curve as viewed in plan view as particularly shown in FIGS. 10 and 14.

With reference to FIGS. 7-9, the plurality of air passageways 14 form a matrix having a plurality of columns of air passageways 14 and a plurality of rows of air passageways. The plurality of columns of air passageways 14 are arranged in a juxtaposed manner and extend rectilinearly in the height-wise direction H and the plurality of rows are arranged in a juxtaposed manner and extend rectilinearly in the length-wise direction L.

Figure 10:
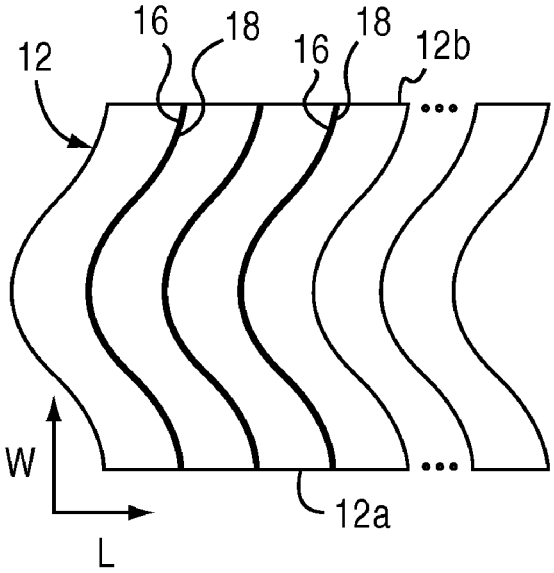
FIG. 10 is top plan view of the louver module shown in FIG. 7.

In FIGS. 7-10 and 12, the louver module body 12 includes a plurality of first panel members 16 and a plurality of second panel members 18. As described in more detail below, the plurality of first panel members 16 fabricated from plastic resins or any other thin formable material such as composites or metals are interspersed with the plurality of second panel members 18 fabricated from plastic resins or any other thin formable material such as composites or metals in an alternating fashion. At least one of the first panel members 16 is disposed between and connected to adjacent ones of the second panel members 18 in a facially opposed manner and at least one of the second panel members 18 is disposed between and connected to adjacent ones of the first panel members 16 in a facially opposed manner to form a stacked arrangement of alternating ones of the first and second panel members as shown in FIGS. 7-10. The first and second panel members 16 and 18 are connected together in a conventional manner such as by employing an adhesive although other conventional methods could be used to fabricate the louver module 10 of the present invention such as by mechanical bonding, plastic welding, ultrasonic bonding, RF bonding, fusion bonding and the like. As illustrated in FIGS. 8, 10 and 12, each one of the plurality of first panel members 16 has a generally sinusoidal configuration as viewed in the length-width plane PLW and each one of the plurality of second panel members 18 has a generally sinusoidal configuration as viewed in the length-width plane PLW.

Figure 11:
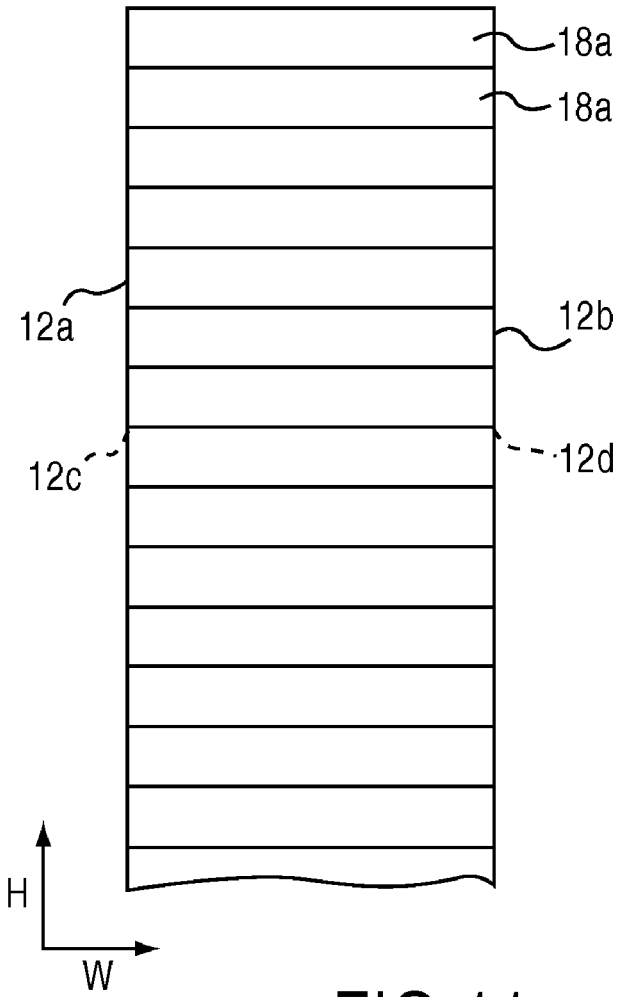
FIG. 11 is a side elevational view of the louver module shown in FIG. 7.

As best shown in FIG. 9 and as shown in FIGS. 8, 11 and 12, the plurality of second panel members 18 include a plurality of folded sections 18*a* with individual ones of the folded sections 18*a* extending generally in the width-wise direction W (best shown in FIG. 11). The folded sections 18*a* are folded along a line extending to and between the inlet opening and the outlet opening.

As shown in FIGS. 7, 8 and 11, the louver module body 12 has an exterior side 12*a* and an interior side 12*b* that is disposed opposite the exterior side 12*a*. In FIGS. 11, 13 and 14, each one of the plurality of air passageways 14 has an inlet opening 12*c* positioned on the exterior side 12*a* and an outlet opening 12*d* positioned on the interior side. The inlet opening 12*c* directs air into respective ones of the plurality of air passageways 14 and the outlet opening 12*d* directs air out of the respective ones of the plurality of air passageways 14.

In this first embodiment of the louver module 10, it is preferred that the configuration of the inlet opening 12*c* and the outlet opening 12*d* represents the shape of the cross-section of the entire air passageway 14. In this instance, the cross-sectional configuration of the first exemplary embodiment of the louver module 10 of the present invention is substantially square. One skilled in the art would appreciate that a square is also a rectangle. Although not by way of limitation, it is preferred that the cross-sectional configuration of each one of the plurality of air passageways 14 is substantially uniform throughout the air passageway 14, i.e., from the inlet opening 12*c* through the outlet opening 12*d*.

As best illustrated in FIGS. 13 and 14, the serpentine configuration includes a first curved air passageway portion 14*a*, a second curved air passageway portion 14*b* and an intermediate curved air passageway portion 14*c*. The intermediate curved air passageway portion 14*c* is disposed between and is in fluid communication with the first and second curved air passageway portions 14*a* and 14*b* respectively. For explanation purposes only for the first exemplary embodiment of the louver module 10 of the present invention, an imaginary reference line IRL shown in FIGS. 8, 13 and 14 extends from and between the inlet and outlet opening 12*c* and 12*d* making point-contact at the respective inlet and outlet openings 12*c* and 12*d* as viewed in the length-width plane PLW. The imaginary reference line IRL extends parallel to the width-wise direction W for the first exemplary embodiment of louver module 10 of the invention. The first and second curved air passageway portions 14*a* and 14*b* are curved in a first direction while the intermediate curved air passageway portion 14*c* is curved in a second direction generally opposite the first radial direction. More particularly, as shown in FIG. 14, the intermediate curved air passageway portion 14*c* faces the imaginary reference line IRL while the first and second curved air passageway portions 14*a* and 14*b* respectively faces generally away from the imaginary reference line IRL. In other words, the first and second curved air passageway portions 14*a* and 14*b* are curved generally away from the imaginary reference line IRL while the intermediate curved air passageway portion 14*c* is curved towards the imaginary reference line IRL.

Furthermore, with reference to FIGS. 8, 10, 13 and 14, the first, second and intermediate curved air passageway portions 14*a*, 14*b* and 14*c* curve in the length-wise direction L away from and relative to the imaginary reference line IRL. Note also in FIGS. 13 and 14 that an apex point AP is disposed apart from the imaginary reference line at a distance Dx. In FIG. 13, the air passageway 14 has a passageway opening width POW that extends in the length-wise direction L. Although not by way of limitation but for example only, the distance Dx is equal to the passageway opening width POW. However, one of ordinary skill in the art would appreciate that the distance Dx might be larger than the passageway opening width POW or might be smaller than the passageway opening width POW so long as sunlight SL can be inhibited from entering into the cabinet 102 to prevent the sunlight from impinging upon the water in the water basin 113. However, as illustrated in FIG. 14, sunlight SL represented by the dashed arrow enters into the inlet opening 12*c* and impinges adjacent the apex point AP thereby the sunlight is effectively blocked from entering into the water basin 113. One of ordinary skill in the art would appreciate that minimizing the amount of sunlight that enters into the water basin 113 would also be acceptable without departing from the spirit of the invention.

Figure 15:
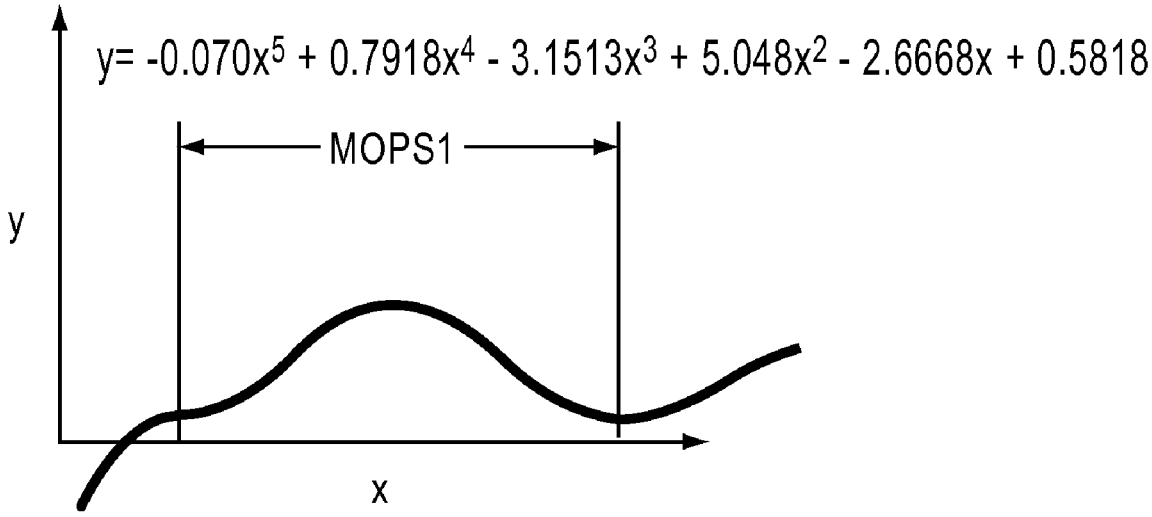
FIG. 15 is an x-y graph illustrating a multiple order polynomial, a portion of which mathematically represents the top plan configuration of the air passageway illustrated in FIGS. 13 and 14.
Figure 16:
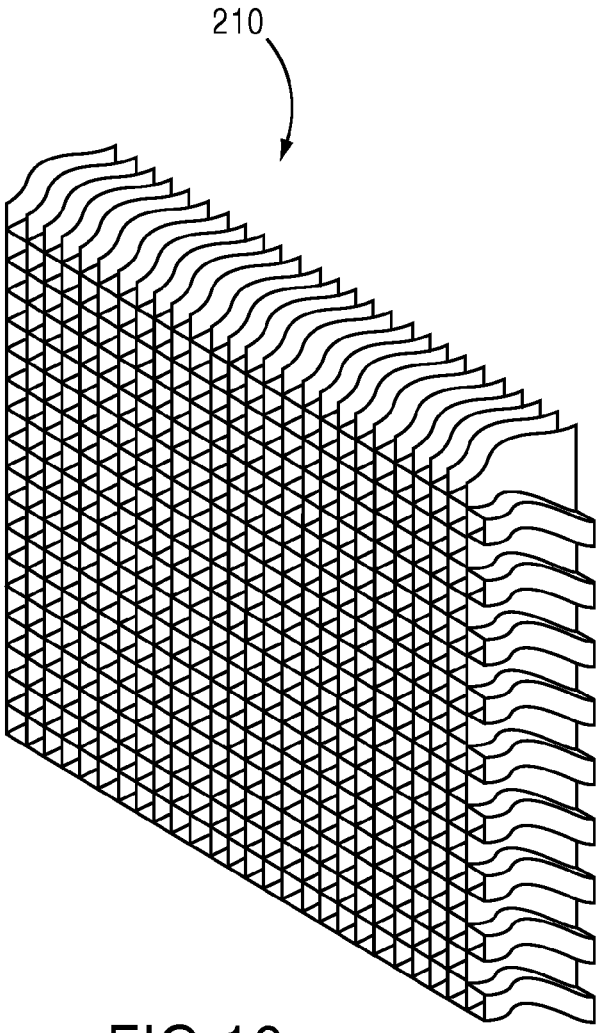
FIG. 16 is a perspective view of a second exemplary embodiment of the louver module of the present invention.
Figure 17:
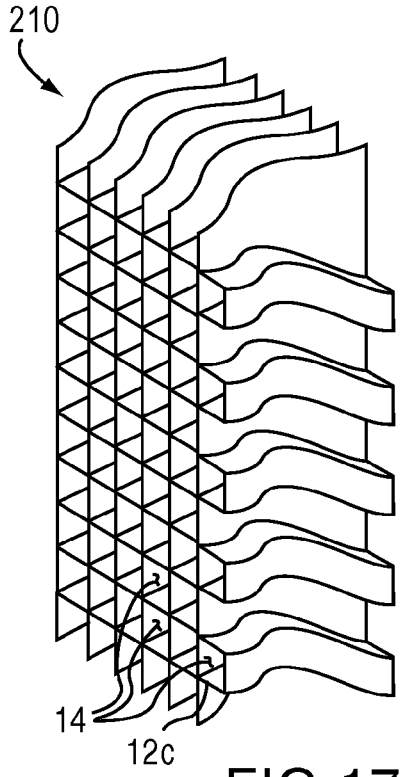
FIG. 17 is an enlarged partial perspective view of the louver module shown in FIG. 16.
Figure 19:
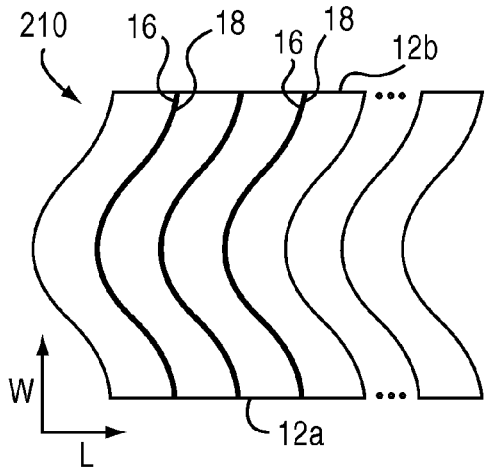
FIG. 19 is top plan view of the louver module shown in FIG. 16.
Figure 18:
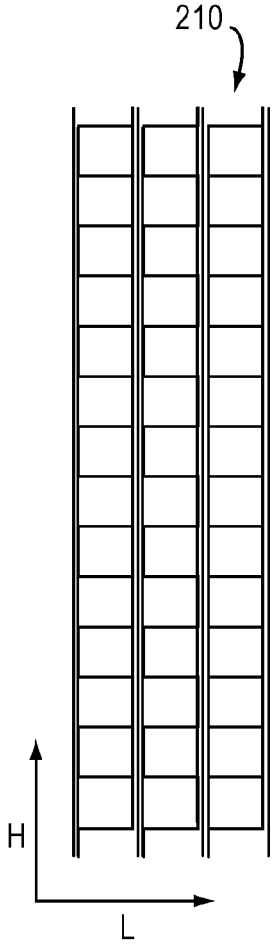
FIG. 18 is a side elevational view of the louver module shown in FIG. 16.

FIG. 15 is an x-y graph illustrating a multiple order polynomial. Although not by way of limitation but by example only, the multiple order polynomial is represented by the following equation:

$$y=-0.0701x^5+0.7918x^4-3.1513x^3+5.048x^2-2.6668x+0.5818.$$

However, the inventors believe that the multiple order polynomial is at least a fourth order multiple order polynomial and that the constants preceding each "x" variable can change without departing from the spirit of the invention.

A skilled artisan would comprehend that the illustrated multiple order polynominal is only partially represented in FIG. 15 and is not illustrated completely accurately or precisely to scale. However, in FIGS. 13, 14 and 15, the serpentine configuration for the first exemplary embodiment of the louver module 10 of the present invention is defined by a multiple order polynomial segment MOPS1 of the multiple order polynomial. In other words, the multiple order polynomial segment MOPS1 mathematically represents the air passageway configuration of the first exemplary embodiment of the louver module 10 of present invention. This multiple order polynomial segment MOPS1 was derived from a computational fluid dynamics analysis software program in order to minimize pressure loss across the air passageway 14. Since the air passageway 14 has, in general terms, three bends, it was necessary to employ computational fluid dynamics analysis software to determine the serpentine configuration of the air passageway 14 in order to minimize the pressure loss across the air passageway 14 as air flowed therethrough.

Also, note that the inlet opening 12*c* and the outlet opening 12*d* make point-contact at respective points c and d along the imaginary reference line IRL. A skilled artisan would comprehend that the inlet opening 12*c* and the outlet opening 12*d* would facially oppose one another if the serpentine configuration of the air passageway 14 was hypothetically straightened.

Figure 20:
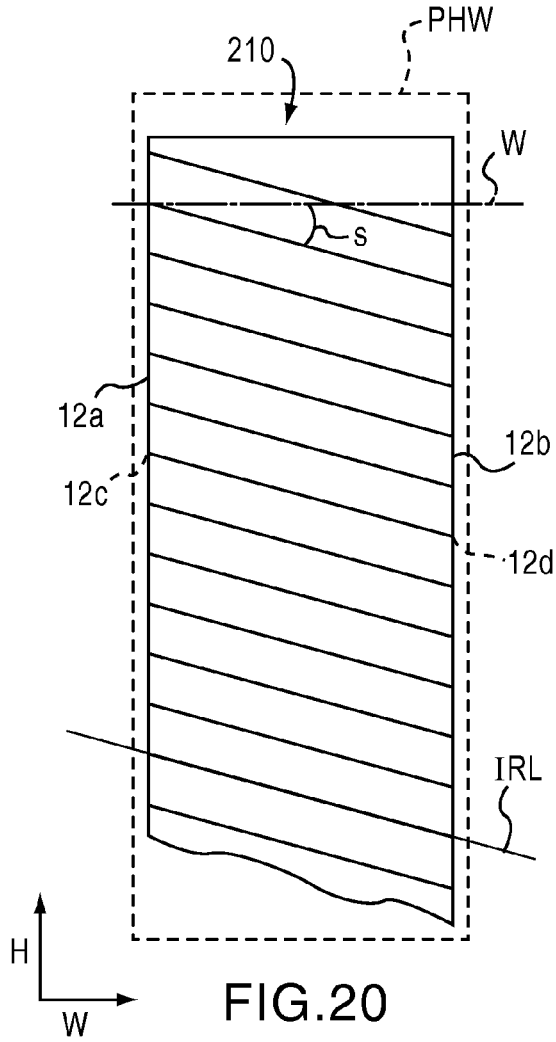
FIG. 20 is a side elevational view of the louver module shown in FIG. 16.
Figure 21:
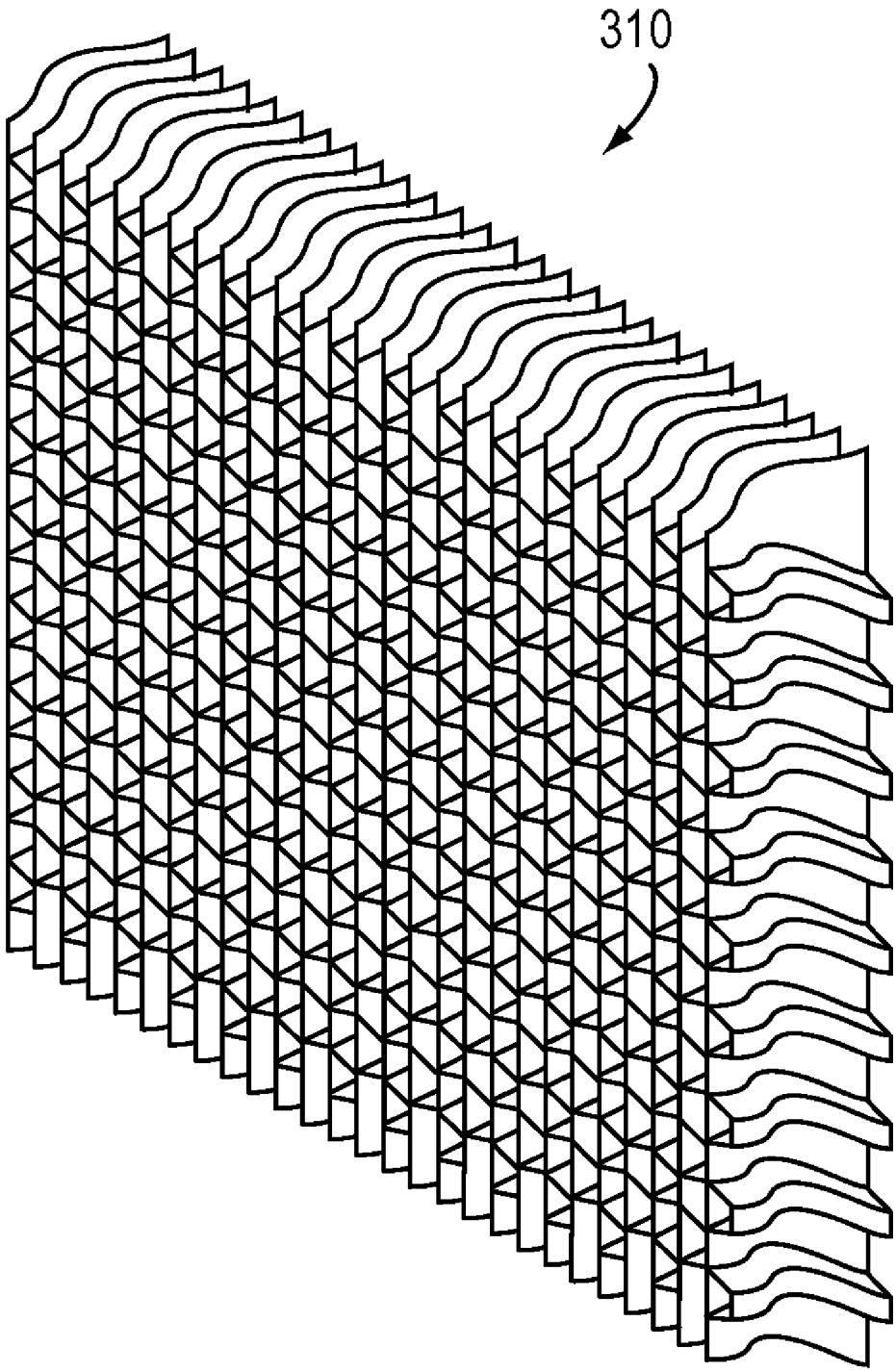
FIG. 21 is a perspective view of a third exemplary embodiment of the louver module of the present invention.
Figure 24:
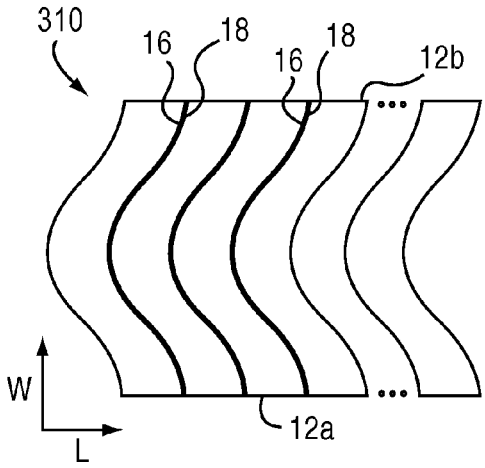
FIG. 24 is top plan view of the louver module shown in FIG. 21.

A second exemplary embodiment of a louver module 210 of the present invention is introduced in FIGS. 16-20. The second exemplary embodiment of the louver module 210 is substantially similar to the first exemplary embodiment of the louver module 10 except for the orientation of the serpentine air passageways 14. As best shown in FIGS. 16, 17, 18 and 20, each one of the plurality of air passageways is oriented at a downwardly angle S. The downwardly angle S is in an approximate range of 1° to 45° as viewed in the height-width plane PHW. However, it is preferred that the approximate range is approximately between 20° and 30°. More specifically, each serpentine air passageway 14 extends downwardly as viewed from the respective inlet openings 12*c* to the respective outlet openings 12*d* as best shown in FIG. 20 along the imaginary reference line IRL. As best shown in FIG. 20, each one of the outlet openings 12*d* is positioned on the interior side 12*b* and each one of the inlet openings 12*c* positioned on the exterior side 12*a* and is disposed above respective ones of the outlet openings 12*d* as viewed in the height-width plane PHW.

Figure 22:
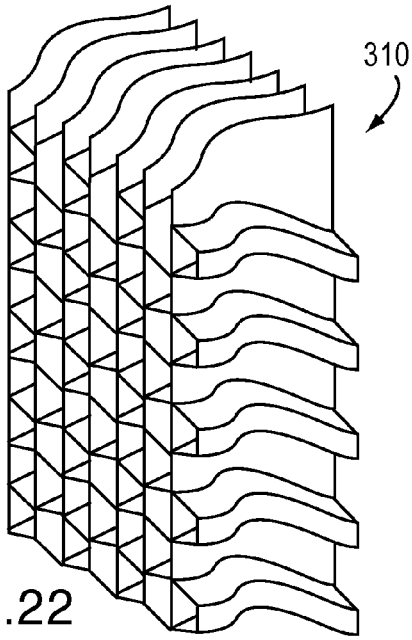
FIG. 22 is an enlarged partial perspective view of the louver module shown in FIG. 21.
Figure 23:
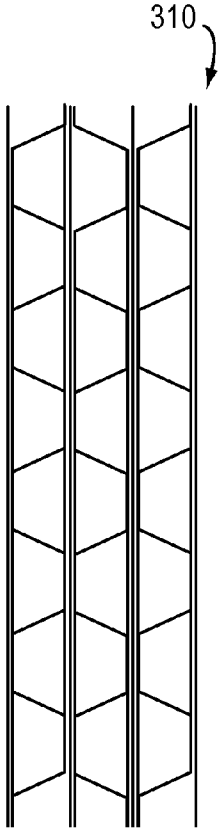
FIG. 23 is a side elevational view of the louver module shown in FIG. 21.
Figure 25:
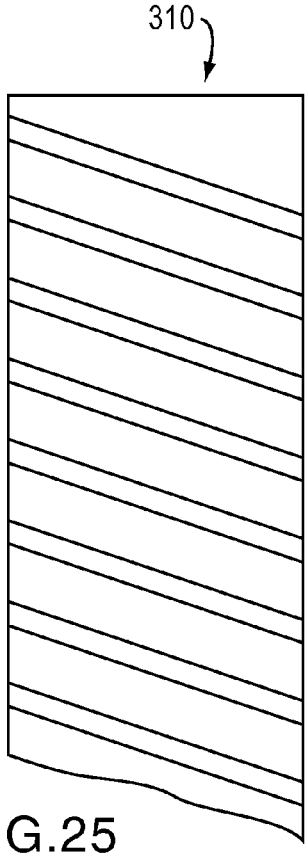
FIG. 25 is a side elevational view of the louver module shown in FIG. 21.

The third exemplary embodiment of a louver module 310 of the present invention is introduced in FIGS. 21-25. The third exemplary embodiment of the louver module 310 is substantially similar to the second exemplary embodiment of the louver module 210 except for the cross-sectional configuration of the serpentine air passageways 14. Specifically, each one of the plurality of air passageways 14 has a cross-sectional configuration in a shape of a trapezoid as best shown in FIGS. 22 and 23.

Figure 26:
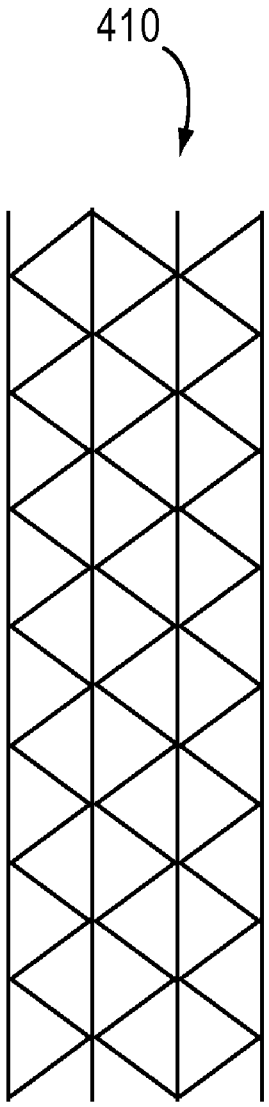
FIG. 26 is a side elevational view of a fourth exemplary embodiment of the louver module of the present invention.

A fourth exemplary embodiment of a louver module 410 of the present invention is shown in FIG. 26. The fourth exemplary embodiment of the louver module 410 is substantially similar to the second exemplary embodiment of the louver module 210 except for the cross-sectional configuration of the serpentine air passageways 14. As shown in FIG. 26, each one of the plurality of air passageways 14 has a cross-sectional configuration in a shape of a triangle.

Figure 27:
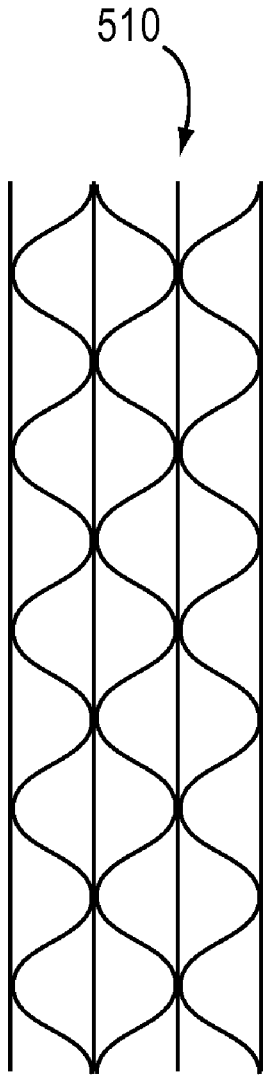
FIG. 27 is a side elevational view of a fifth exemplary embodiment of the louver module of the present invention.

A fifth exemplary embodiment of a louver module 510 of the present invention is shown in FIG. 27. The fifth exemplary embodiment of the louver module 510 is substantially similar to the second exemplary embodiment of the louver module 210 except for the cross-sectional configuration of the serpentine air passageways 14. As shown in FIG. 27, each one of the plurality of air passageways 14 has a cross-sectional configuration in a shape of a standard normal distribution curve.

Although not by way of limitation, all of the above exemplary embodiments of the present invention might have air passageways that, as viewed in plan view, are slightly modified. Examples of these slightly-modified air passageways are illustrated in FIGS. 28-31.

Figure 28:
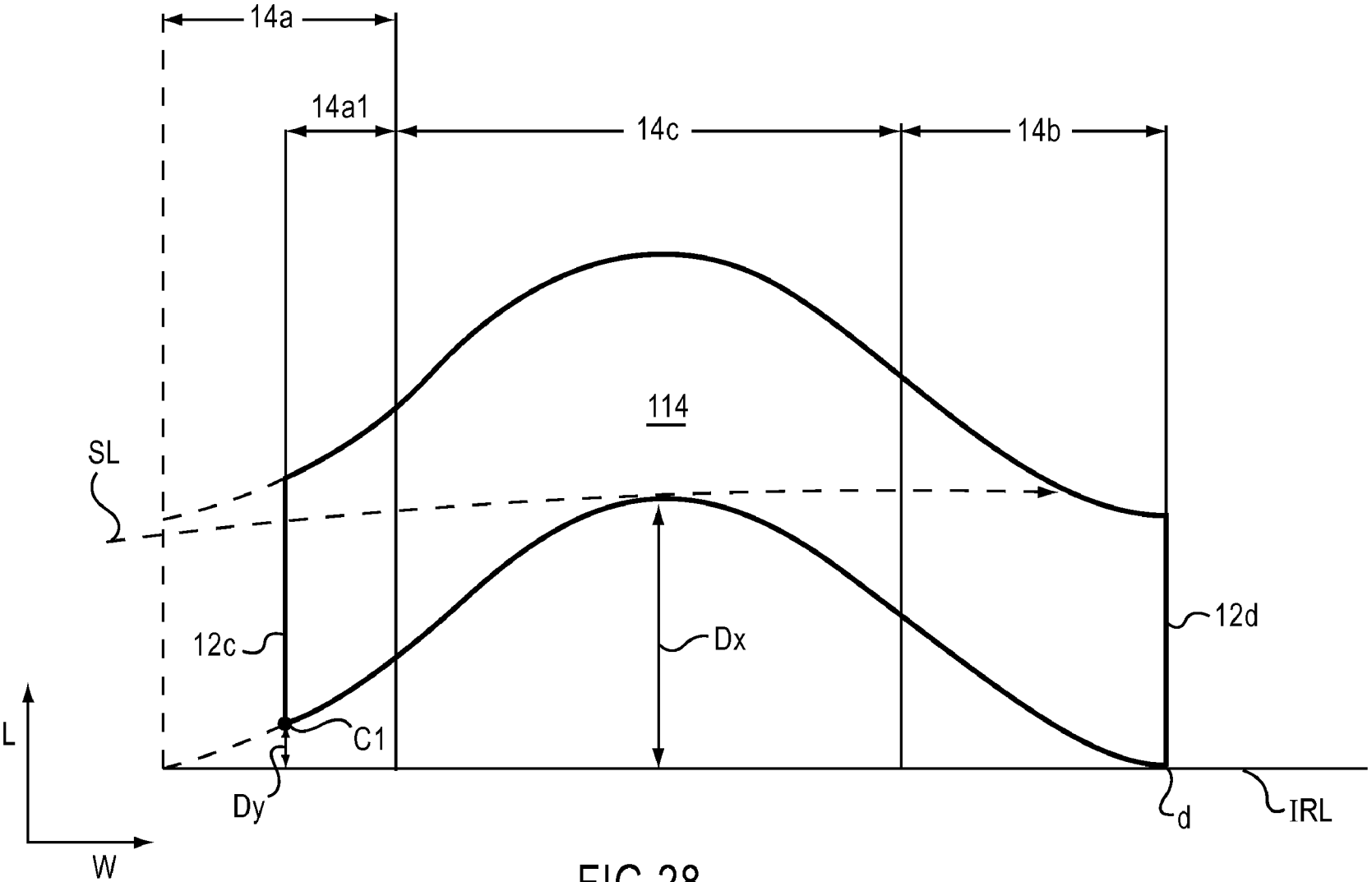
FIG. 28 is a top plan view of a first example of a slightly-modified air passageway.

In FIG. 28, the first curved air passageway portion 14*a* is truncated to a first truncated curved air passageway portion 14*a*1 to form an air passageway 114. As a result, note that the inlet opening 12*c* does not make point contact along the imaginary reference line IRL but is disposed apart from the imaginary reference line IRL a distance Dy in the length-wise direction L. A skilled artisan would comprehend that the inlet opening 12*c* and the outlet opening 12*d* would be considered offset from one another in the length-wise direction if the serpentine configuration of the air passageway 114 was hypothetically straightened. Also, note that sunlight SL is inhibited from entering into the water basin 113 even though the first truncated curved air passage portion 14*a*1 is shorter than the first curved air passageway portion 14*a*.

Figure 29:
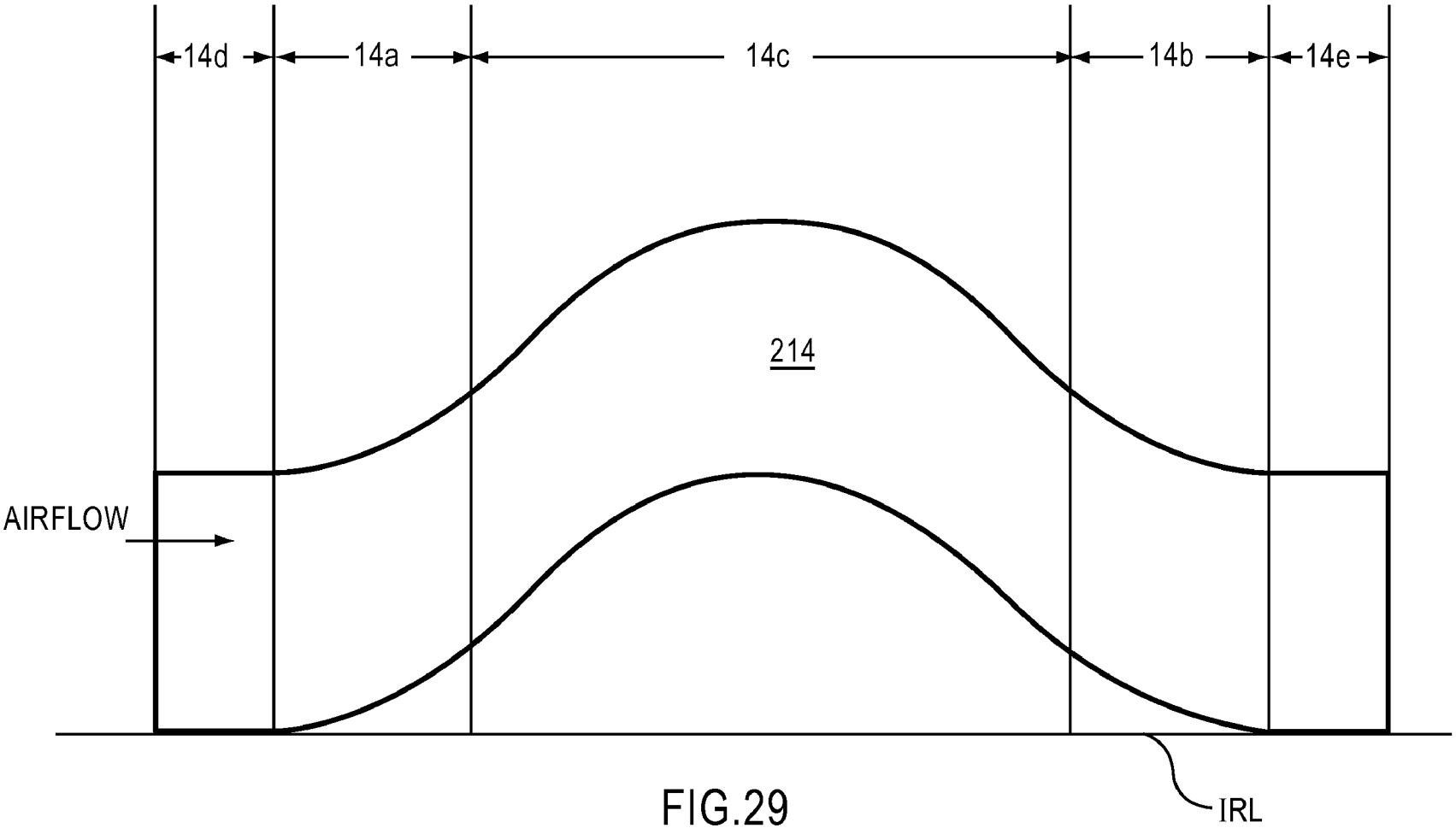
FIG. 29 is a top plan view of a second example of a slightly-modified air passageway.

In FIG. 29, the serpentine configuration is similar to the serpentine configuration of the air passageway 14 in FIG. 14. However, an air passageway 214 includes a first straight air passageway portion 14*d* connected directly to and in fluid communication with the first curved air passageway portion 14*a* as an air inlet into the louver module body and a second straight air passageway portion 14*e* connected directly to and in fluid communication with the second curved air passageway portion 14*b* as an air outlet out of the louver module body. One of ordinary skill in the art would comprehend that the first straight air passageway portion 14*d* would cause air flowing into the louver module to flow parallel to the imaginary reference line IRL and the second straight air passageway portion 14*e* would cause air to flow from the louver module parallel to the imaginary reference line IRL. Thus, air from the louver module would flow generally parallel to the width-wise direction of the louver module into the water basin area.

Figure 30:
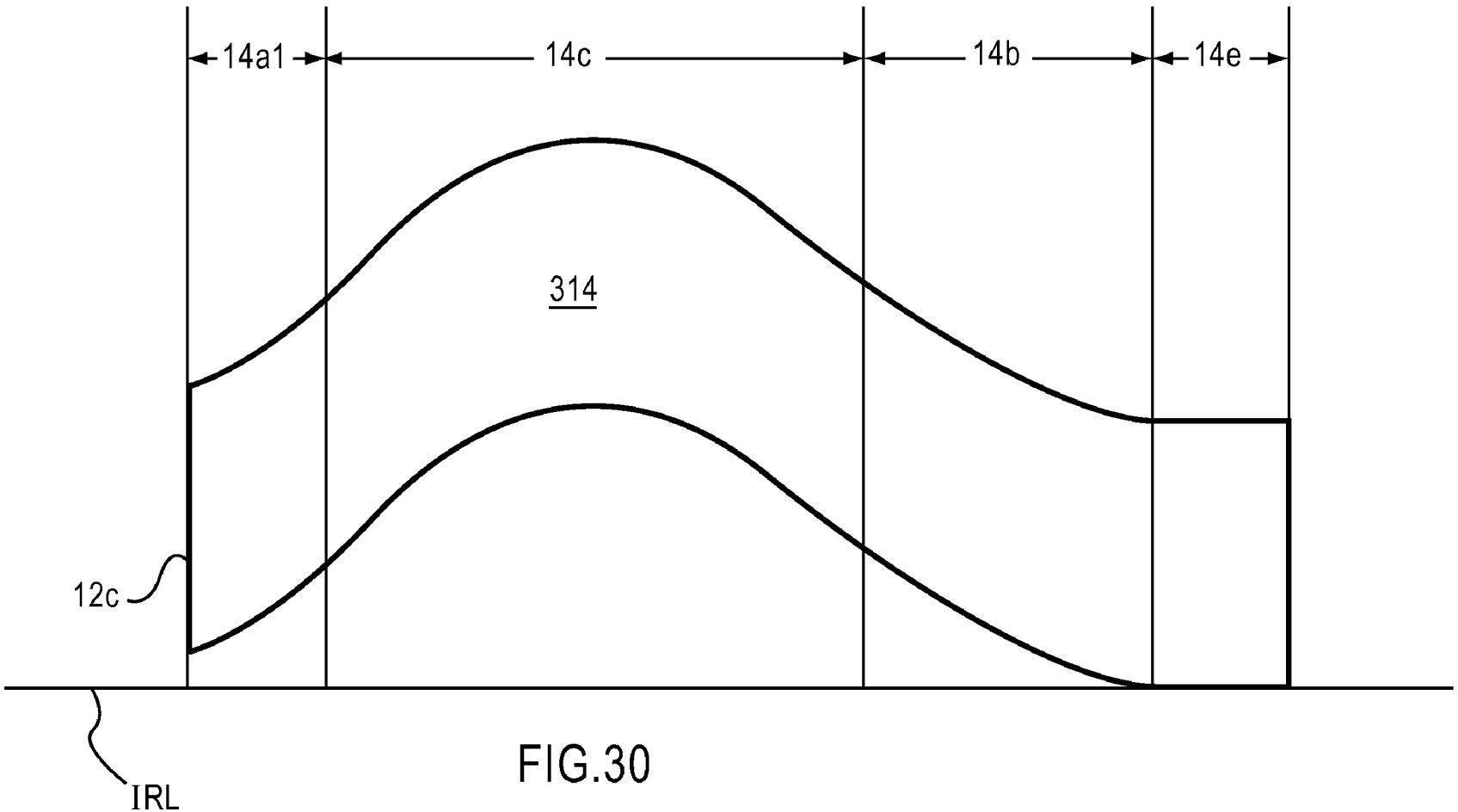
FIG. 30 is a top plan view of a third example of a slightly-modified air passageway.

In FIG. 30, the serpentine configuration is similar to the serpentine configuration of the air passageway 114 in FIG. 28 except that an air passageway 314 includes the second straight air passageway portion 14*e* connected directly to and in fluid communication with the second curved air passageway portion 14*b* as an air outlet out of the louver module body.

Figure 31:
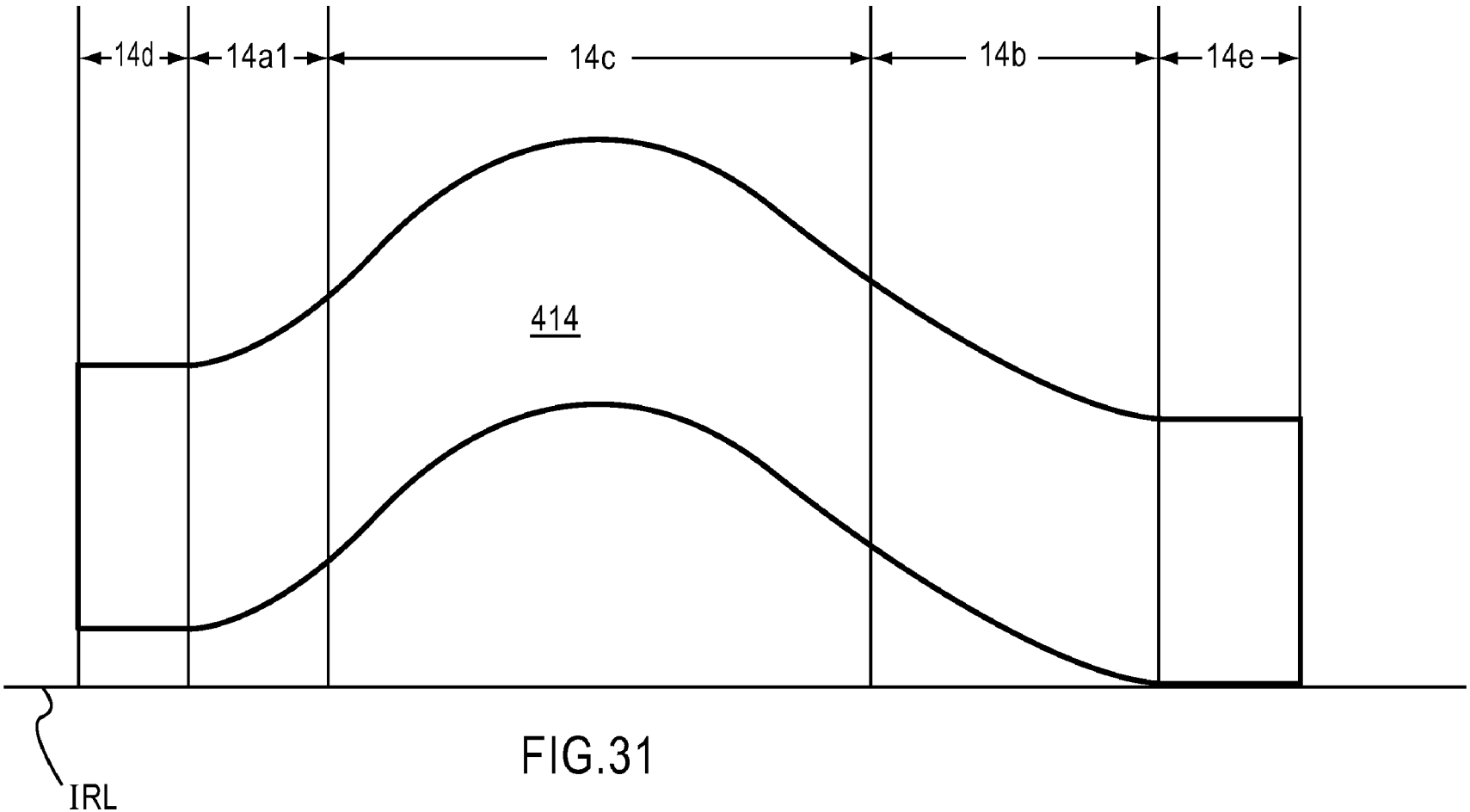
FIG. 31 is a top plan view of a fourth example of a slightly-modified air passageway.

In FIG. 31, the serpentine configuration is similar to the serpentine configuration of the air passageway 314 in FIG. 30 except that an air passageway 414 includes the first straight air passageway portion 14*d* connected directly to and in fluid communication with the first truncated curved air passageway portion 14*a*1 as an air inlet into the louver module body and the second straight air passageway portion 14*e* connected directly to and in fluid communication with the second curved air passageway portion 14*b* as an air outlet out of the louver module body.

In view of FIGS. 28-31, it would be appreciated by a skilled artisan that the serpentine configuration can include at least a first straight air passageway portion 14*d* connected directly to and in fluid communication with the first curved air passageway portion 14*a* or with the first truncated curved air passageway portion 14*a*1 as the air inlet into the louver module body 12 and a second straight air passageway portion 14*e* connected directly to and in fluid communication with the second curved air passageway portion 14*b* as an air outlet out of the louver module body 12.

Figure 32:
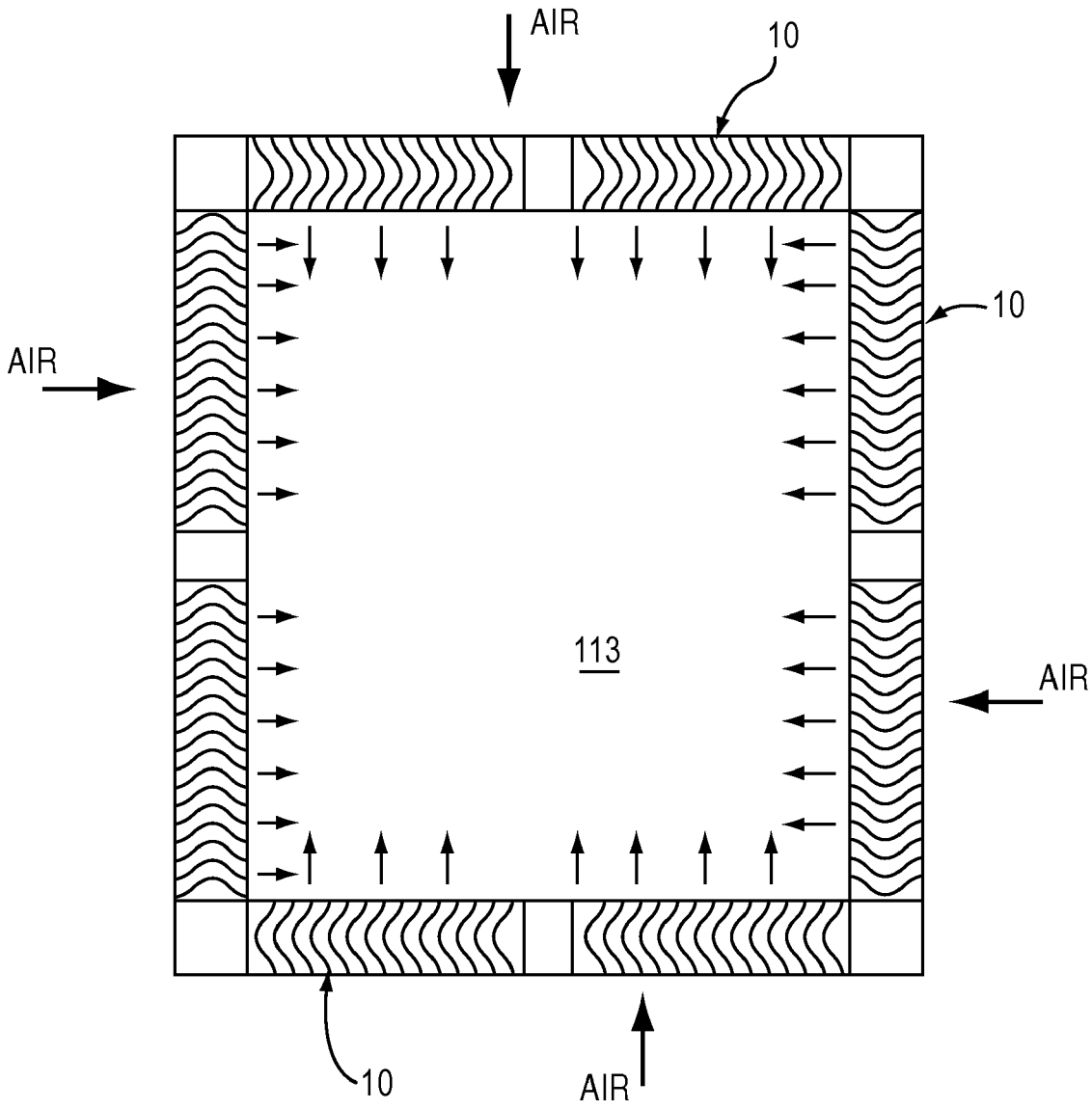
FIG. 32 is a top plan view taken along lines 6-6 in FIG. 1 illustrating air entering into a cabinet through louver modules of the present invention that results in inhibiting or eliminating air swirl.

As illustrated in FIG. 32, the louver module of the present invention has a plurality of air passageways that inhibit sunlight from entering into the cabinet of a heat exchanger and simultaneously permit air to enter into the cabinet generally parallel to the width-wise direction of the louver and maintaining a low pressure loss across the louver module. As a result, it is theorized that air swirl is now inhibited or even eliminated as a result of the configuration of the air passageways of the louver module of the present invention and, simultaneously, sunlight is inhibited from entering into the cabinet of the heat exchanger.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. A louver module, comprising:

a louver module body extending in a length-wise direction, a width-wise direction and a height-wise direction with the length-wise direction, the width wise-direction and the height wise direction oriented perpendicularly relative to one another, the louver module body having a plurality of air passageways extending therethrough generally in the width-wise direction, each one of the plurality of air passageways having at least a serpentine air passageway section formed in a continuously nonlinear serpentine configuration the serpentine air passageway section having an air inlet opening defining an entrance into the serpentine air passageway section and an air outlet opening defining an exit out of the serpentine air passageway section, the air inlet opening and the air outlet opening being disposed apart from one another at a width-wise distance W, the continuously nonlinear serpentine configuration commencing at the air inlet opening, continuing uninterruptedly along the serpentine air passageway section and terminating at the air outlet opening, wherein the serpentine air passageway section includes a first curved air passageway portion curving at a first constantly-changing rate of curvature, a second curved air passageway portion curving at a second constantly-changing rate of curvature and an intermediate curved air passageway portion disposed between, in fluid communication with and connected directly to the first and second curved air passageway portions, wherein the first and second curved air passageway portions are curved in a first direction and the intermediate curved air passageway portion is curved in a second direction generally opposite the first direction, wherein the intermediate curved air passageway portion is generally arc-shaped having an apex, wherein the apex is disposed between but not including the air inlet opening and one half of the width-wise distance W measured from the air inlet opening, and wherein the first constantly-changing rate of curvature is greater than the second constantly-changing rate of curvature to form the continuously nonlinear serpentine configuration to resemble a skewed distribution curve.

2. A louver module according to claim 1, wherein the first, second and intermediate curved air passageway portions curve in the length-wise direction.

3. A louver module according to claim 1, wherein the continuously nonlinear serpentine configuration is defined by a multiple order polynomial segment of a multiple order polynomial.

4. A louver module according to claim 3, wherein the multiple order polynomial is at least a fourth order multiple order polynomial.

5. A louver module according to claim 4, wherein the multiple order polynomial is based upon the following equation:

$$y=-0.0701x^5+0.7918x^4-3.1513^3+5.048x^2-2.6668x+0.5818.$$

6. A louver module according to claim 1, wherein each one of the plurality of air passageways includes at least a first straight air passageway portion connected directly to and in fluid communication with the first curved air passageway portion as an air inlet into the louver module body and a second straight air passageway portion connected directly to and in fluid communication with the second curved air passageway portion as an air outlet out of the louver module body.

7. A louver module according to claim 1, wherein each one of the plurality of air passageways has the air inlet opening directing air into respective ones of the plurality of air passageways and the air outlet opening directing air out of the respective ones of the plurality of air passageways.

8. A louver module according to claim 7, wherein the height-wise direction and the width-wise direction define a height-width plane and wherein the louver module body has an exterior side and an interior side disposed opposite the exterior side, each one of the air inlet openings is positioned on the exterior side, each one of the air outlet openings is positioned on the interior side and each one of the air inlet openings is disposed above respective ones of the air outlet openings as viewed in the height-width plane.

9. A louver module according to claim 8, wherein each one of the plurality of air passageways is oriented at a downwardly angle in a range of 1° to 45° as viewed in the height-width plane from the respective air inlet opening to the respective air outlet opening.

10. A louver module according to claim 1, wherein the plurality of air passageways has a cross-sectional configuration as viewed in the height-wise direction and the length-wise direction that includes a square, a rectangle, a trapezoid, a triangle and a standard normal distribution curve.

11. A louver module according to claim 1, wherein the louver module body includes a plurality of first panel members and a plurality of second panel members with the plurality of first panel members being interspersed with the plurality of second panel members in an alternating fashion such that at least one of the first panel members is disposed between and connected to adjacent ones of the second panel members in a facially opposed manner and at least one of the second panel members is disposed between and connected to adjacent ones of the first panel members in a facially opposed manner to form a stacked arrangement of alternating ones of the first and second panel members.

12. A louver module according to claim 11, wherein each one of the plurality of air passageways has the air inlet opening directing air into respective ones of the plurality of air passageways and the air outlet opening directing air out of the respective ones of the plurality of air passageways, the length-wise direction and the width-wise direction define a length-width plane, each one of the plurality of first panel members has a skewed continuously nonlinear serpentine shape as viewed from the length-width plane and each one of the plurality of second panel members has a generally skewed continuously nonlinear serpentine shape as viewed from the length-width plane and includes a plurality of folded sections with each folded section folded along an imaginary reference line extending to and between the air inlet opening and the air outlet opening.

13. A louver module according to claim 12, wherein the height-wise direction and the width-wise direction define a height-width plane and wherein the louver module body has an exterior side and an interior side disposed opposite the exterior side, each one of the plurality of air passageways has the air inlet opening positioned on the exterior side and the air outlet opening is positioned on the interior side and each one of the air inlet openings is disposed above respective ones of the air outlet openings as viewed in the height-width plane.

14. A louver module according to claim 13, wherein each one of the plurality of air passageways is oriented at a downwardly angle in a range of 1° to 45° as viewed in the height-width plane from the respective air inlet opening to the respective air outlet opening.

15. A louver module according to claim 1, wherein the plurality of air passageways form a matrix having a plurality of columns and a plurality of rows.

16. A louver module according to claim 15, wherein the plurality of columns of air passageways are arranged in a juxtaposed manner and extend rectilinearly in the height-wise direction and the plurality of rows are arranged in a juxtaposed manner and extend rectilinearly in the length-wise direction.

17. A louver module, comprising:

a louver module body extending in a length-wise direction, a width-wise direction and a height-wise direction with the length-wise direction, the width wise-direction and the height wise direction oriented perpendicularly relative to one another, the louver module body having a plurality of air passageways extending therethrough generally in the width-wise direction, each one of the plurality of air passageways having at least a serpentine air passageway section formed in a continuously nonlinear serpentine configuration, the serpentine air passageway section having an air inlet opening defining an entrance into the serpentine air passageway section and an air outlet opening defining an exit out of the serpentine air passageway section, the air inlet opening and the air outlet opening being disposed apart from one another at a width-wise distance W, the continuously nonlinear serpentine configuration commencing at the air inlet opening, continuing uninterruptedly along the serpentine air passageway section and terminating at the air outlet opening, wherein the serpentine air passageway section includes a first curved air passageway portion, a second curved air passageway portion and an intermediate curved air passageway portion disposed between, in fluid communication with and connected directly to the first and second curved air passageway portions, wherein the first and second curved air passageway portions are curved in a first direction and the intermediate curved air passageway portion is curved in a second direction generally opposite the first direction, wherein the intermediate curved air passageway portion is generally arc-shaped having an apex, wherein one half of the width-wise distance W defines a central location of the serpentine air passageway section and wherein the apex is disposed downstream of the air inlet opening and upstream of the central location of the serpentine air passageway section rendering the first and second curved air passageway portions being shaped differently from one another so as to form the continuously nonlinear serpentine configuration to resemble a skewed distribution curve, wherein the first curved air passageway portion is more curved than the second curved air passageway portion.

* * * * *